US010777866B2

(12) United States Patent
Yang et al.

(10) Patent No.: US 10,777,866 B2
(45) Date of Patent: Sep. 15, 2020

(54) QUASI-CIRCULATOR USING ASYMMETRIC DIRECTIONAL COUPLER

(71) Applicant: RESEARCH COOPERATION FOUNDATION OF YEUNGNAM UNIVERSITY, Gyeongsan-si, Gyeongsangbuk-do (KR)

(72) Inventors: Jong Ryul Yang, Daegu (KR); Bo Yoon Yoo, Daegu (KR); Ha Neul Lee, Gyeongsan-si (KR); Ju Hee Son, Daegu (KR)

(73) Assignee: RESEARCH COOPERATION FOUNDATION OF THE YEUNGNAM UNIVERSITY (KR)

( * ) Notice: Subject to any disclaimer, the term of this patent is extended or adjusted under 35 U.S.C. 154(b) by 17 days.

(21) Appl. No.: 16/108,514

(22) Filed: Aug. 22, 2018

(65) Prior Publication Data

US 2019/0067774 A1 Feb. 28, 2019

(30) Foreign Application Priority Data

Aug. 23, 2017 (KR) ..... 10-2017-0106785

(51) Int. Cl.

| | |
|---|---|
| ***H01P 5/18*** | (2006.01) |
| ***H01P 5/22*** | (2006.01) |
| ***H01P 1/38*** | (2006.01) |
| ***H01P 1/387*** | (2006.01) |

(52) U.S. Cl.

CPC ..... *H01P 1/38* (2013.01); *H01P 1/387* (2013.01); *H01P 5/18* (2013.01); *H01P 5/227* (2013.01)

(58) Field of Classification Search

CPC ..... H01P 5/12; H01P 5/18; H01P 5/22; H01P 1/38

USPC ..... 333/109, 112, 116

See application file for complete search history.

(56) References Cited

U.S. PATENT DOCUMENTS 3,571,762 A * 3/1971 Smilen ..... H01P 1/185 333/116
3,772,616 A * 11/1973 Imoto ..... H01P 5/028 333/128
5,132,645 A * 7/1992 Mayer ..... H01P 5/227 333/109

(Continued)

FOREIGN PATENT DOCUMENTS

JP 5089502 B2 12/2012
KR 10-0702204 B1 3/2007

(Continued)

OTHER PUBLICATIONS

Extended European Search Report Corresponding to European Patent Application No. 18190139.8 dated Jan. 23, 2019 (10 pages).

(Continued)

*Primary Examiner* — Dean O Takaoka
(74) *Attorney, Agent, or Firm* — Myers Bigel, P.A.

(57) ABSTRACT

Disclosed is a quasi-circulator using an asymmetric directional coupler. The quasi-circulator using the asymmetric directional coupler according to an embodiment of the present invention may enhance a characteristic of isolating a transmitting signal from a receiving signal with the same characteristic as transmitting signal loss of a symmetric directional coupler in the related art by arranging impedance of each line of a directional coupler asymmetrically.

9 Claims, 5 Drawing Sheets

(56) References Cited

U.S. PATENT DOCUMENTS

| | | | | |
|---|---|---|---|---|
| 5,235,296 | A * | 8/1993 | Saka | H01P 5/227 333/109 |
| 9,196,945 | B2 * | 11/2015 | Khlat | H04B 1/0057 |
| 2009/0108954 | A1 * | 4/2009 | Cheung | H01P 1/10 333/1.1 |
| 2014/0286204 | A1 * | 9/2014 | Knox | H04L 12/40013 370/278 |

FOREIGN PATENT DOCUMENTS

| | | | |
|---|---|---|---|
| KR | 10-2008-0096172 | A | 10/2008 |
| KR | 10-2009-0047054 | A | 5/2009 |

OTHER PUBLICATIONS

Fakoukakis et al. "Design of passive UHF RFID Circulators/Duplexers Using Directional Couplers" IEEE 2012 International Conference on RFID—Technologies and Applications, 6 pages.

Bai et al. "A Novel RX-TX Front-Ends for Passive RFID Reader with High Isolation" IEEE 2007 International Symposium on Microwave, Antenna, Propagation, and EMC Technologies for Wireless Communications, 4 pages.

Yoo et al., "Quasi-Circulator Using an Asymmetric Coupler for Tx Leakage Cancellation", Electronics, vol. 7, No. 9, Sep. 1, 2018, 15 pp.

* cited by examiner

QUASI-CIRCULATOR USING ASYMMETRIC DIRECTIONAL COUPLER

RELATED APPLICATION

This application claims the benefit of Korean Patent Application No. 10-2017-0106785, filed on Aug. 23, 2017, in the Korean Intellectual Property Office, the disclosure of which is incorporated herein in its entirety by reference.

BACKGROUND

1. Field

The present invention relates to a quasi-circulator using an asymmetric directional coupler, and more particularly, to a quasi-circulator using an asymmetric directional coupler, in which impedance of each line of a directional coupler is asymmetrically arranged to enhance a characteristic of separating a transmitting signal and a receiving signal with the same characteristic as transmission signal loss of the existing symmetric directional coupler, thereby achieving high transmitting/receiving signal isolation characteristics.

2. Description of the Related Art

In recent years, in wireless communication and miniaturized radar systems, a single antenna has been mainly studied for miniaturization.

In a conventional system using two antennas, some of transmitting signals may be introduced into a receiving signal path through antenna coupling, but two antennas are separated from each other or a structure for increasing a signal leakage characteristic between the antennas or the like is installed, thereby reducing an influence by a transmitting leakage signal. However, in the conventional system using two antennas, since the antenna itself has a physical size determined by a wavelength, which causes limitation in miniaturization of the system and makes it difficult to reduce a system size by adding a structure for reducing the transmitting leakage signal, and as a result, in recent years, in a radio wave application system, a system using one antenna has been actively studied.

In communication and radar systems using one antenna, which are called monostatic systems, some of transmitting signals may be introduced into the receiving signal path through a circulator, thereby causing the receiving signal to exceed an input range of an analog-to-digital converter (ADC) in the receiver and the corresponding received signal may not be recognized and an amplifier itself may be saturated and further, as the magnitude of the transmitting leakage signal increases, the system may be saturated or information may be lost. Therefore, in the monostatic system, an isolation between transmitting and receiving signal paths by the circulator is very useful in order to minimize the transmitting leakage signal.

Therefore, in monostatic communication and radar systems for miniaturization, an isolation characteristic between transmitting and receiving signal paths of the circulator must be improved, which is a very important system specification in deciding system performance and a usable application field.

That is, since the circulator basically advances the signal only to an output port (or output terminal) located at a forward position viewed from an input port (or input terminal) and does not advance the signal in a reverse direction, the transmitting signal path and the receiving signal path should be isolated. Therefore, the isolation characteristic between the transmitting and receiving paths is decided by performance of the circulator. In general, the circulator made of a ferrite material has a large size and is difficult to integrate and is expensive and is not suitable for a very small system configuration implemented as a ubiquitous concept.

That is, it is difficult to be integrated due to the large size of a general circulator device. Therefore, in order to fabricate a circulator having a wide bandwidth characteristic while minimizing and simplifying the structure in terms of design and effectiveness, it is considered that a circulator function is implemented by using a directional coupler and in Korean Patent Unexamined Publication "Compact-Size Quasi Circulator for Isolating TX and RX Signals with Isolation between TX and RX Signals" (10-2009-0047054), a quasi-circulator invention having a high transmitting/receiving signal isolation characteristic by using a first directional coupler, a second directional coupler, and an asymmetric directional coupler is disclosed.

In other words, a quasi-circulator using a directional coupler may serve to transfer the transmitting signal to the antenna and transmit the receiving signal collected by the antenna to a receiver in a wireless system using one transceiving antenna and since the circulator uses a single transceiving antenna, a high transmitting/receiving isolation characteristic is required.

In other words, the quasi-circulator using the directional coupler can be miniaturized due to an advantage that the directional coupler can be manufactured in a size that can be integrated, but it has a disadvantage in that a frequency band in which the transmitting leakage signal is small is narrow and in particular, it is not easy to implement the high transmitting/receiving isolation characteristic.

SUMMARY

The present invention is contrived to solve the problem and an object of the present invention is to provide a quasi-circulator using an asymmetric directional coupler, in which impedance of each line of a directional coupler is asymmetrically arranged to enhance a characteristic of separating, a transmitting signal and a receiving signal with the same characteristic as transmitting signal loss of the existing symmetric directional coupler, thereby achieving high transmitting/receiving signal isolation characteristics.

In a quasi-circulator using an asymmetric directional coupler according to an embodiment of the present invention, the directional coupler may include: a first transmission line in which a transmitter connection terminal is formed at one end and an antenna connection terminal is formed at the other end; a second transmission line disposed to be spaced apart from the first transmission line by a predetermined interval, in which a receiver connection terminal is formed at one end and a high-frequency resistor connection terminal is formed at the other end; a first coupling line vertically connected with the first transmission line, in which the second transmission line and a transmitting signal from the transmitter connection terminal is partially extracted and coupled to the receiver connection terminal; and an second coupling line vertically connected with the first transmission line and the second transmission line, from which the transmitting signal from the transmitter connection terminal is electrically insulated, and impedances of the first transmission line, the second transmission line, the first coupling line, and the second coupling line may be arranged asymmetrically to implement a circulator function of isolating between the transmitting and receiving signals.

Further, in the quasi-circulator using an asymmetric directional coupler according to an embodiment of the present invention, in estimation of each impedance value which causes the impedances of the first transmission line, the second transmission line, the first coupling line, and the second coupling line to be arranged asymmetrically, each impedance value may be estimated by adjusting a ratio of the impedances of the respective lines and an element value connected to an impedance setting port.

In addition, in estimation of each impedance value which causes the impedances of the first transmission line, the second transmission line, the first coupling line, and the second coupling line to be arranged asymmetrically, each impedance value may be estimated by using a design parameter equation.

Moreover, in the quasi-circulator using an asymmetric directional coupler according to an embodiment of the present invention, the high-frequency resistor connection terminal may include a high-frequency resistor element having an impedance value to generate a signal having the same magnitude as and an opposite phase to a signal which leaks from the transmitter connection terminal of the first transmission line to the receiver connection terminal of the second transmission line.

In addition, in the quasi-circulator using an asymmetric directional coupler according to an embodiment of the present invention, the impedance of the first transmission line may be disposed as 40 ohms, the impedance of the second transmission line may be disposed as 35 ohms, the impedance of the first coupling line may be disposed as 60 ohms, and the impedance of the second coupling line may be disposed as 45 ohms, and the impedance connected to the high-frequency resistor connection terminal may be disposed as 45 ohms and respective line impedances of the directional coupler may be thus disposed asymmetrically.

Further, in the quasi-circulator using an asymmetric directional coupler according to an embodiment of the present invention, the design parameter equation may be $|k \cdot m|=1$.

In addition, in the quasi-circulator using an asymmetric directional coupler according to an embodiment of the present invention, the line of the transmitter connection terminal, the line of the antenna connection terminal, and the line of the receiver connection terminal may be all configured to have a characteristic impedance of 50 ohms, and the high-frequency resistor connection terminal may be configured to have an impedance value to generate a reflection signal for offsetting a transmitting leakage signal.

Further, in the quasi-circulator using an asymmetric directional coupler according to an embodiment of the present invention, the high-frequency resistor connected to the high-frequency resistor connection terminal may be configured to have a different value from a reference impedance value (50 ohms).

Moreover, in the quasi-circulator using an asymmetric directional coupler according to an embodiment of the present invention, a connection line of the high-frequency resistor connection terminal may be configured to have a different value from the reference impedance value (50 ohms).

Advantageous Effects

According to an embodiment of the present invention, since a quasi-circulator using an asymmetric directional coupler can be implemented in the same size as a conventional circulator using a symmetrical directional coupler, it is possible to secure a high transmitting/receiving signal isolation characteristic while using the circulator in the same size as an implementation area in the existing system.

Since the quasi-circulator using the asymmetric directional coupler according to an embodiment of the present invention is the same as the conventional circulator using the symmetrical directional coupler in the path loss which occurs between a transmitter and an antenna and a receiver and the antenna, the circulator can transmit a signal without additional loss.

In the quasi-circulator using the asymmetric directional coupler according to an embodiment of the present invention, since the frequency band in which transmitting and receiving losses occur constantly due to an asymmetric structure has a wide broadband characteristic, the circulator can be usefully utilized in next-generation wireless communication and electromagnetic wave systems which require to include more frequency bandwidths.

BRIEF DESCRIPTION OF THE DRAWINGS

The accompanying drawings, which are to provide a further understanding of the present invention, provide embodiments of the present invention together with the detailed description. It is to be understood, however, that technical features of the present invention are not limited to specific drawings and features disclosed in the respective drawings may be combined with each other to constitute a new embodiment.

DETAILED DESCRIPTION

Figure 1:
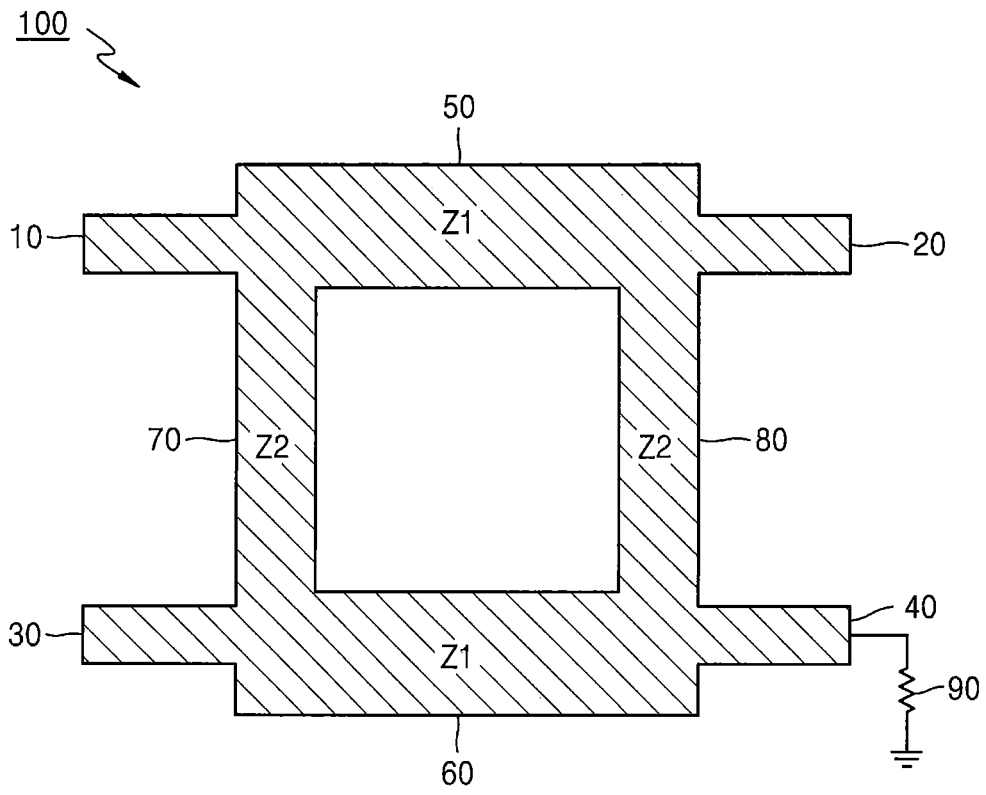
FIG. 1 is a diagram schematically illustrating a configuration of a quasi-circulator using a 4-port symmetrical directional coupler 100 in the related art.

Hereinafter, embodiments of the present invention will be described in detail so as to be easily implemented by those skilled in the art, with reference to the accompanying drawings. However, the present invention may be implemented in various different forms and is not limited to an embodiment described herein. In addition, a part not related with a description is omitted in order to clearly describe the present invention in the drawings and throughout the specification, like reference numerals designate like elements.

Terms used in the present specification will be described in brief and the present invention will be described in detail.

Terms used in the present invention adopt general terms which are currently widely used as possible by considering functions in the present invention, but the terms may be changed depending on an intention of those skilled in the art, a precedent, emergence of new technology, etc. Further, in a specific case, a term which an applicant arbitrarily selects is present and, in this case, a meaning of the term will be disclosed in detail in a corresponding description part of the invention. Accordingly, a term used in the present invention should be defined based on not just a name of the term but a meaning of the term and contents throughout the present invention.

Further, throughout the specification, unless explicitly described to the contrary, the word "comprise" and variations such as "comprises" or "comprising" will be understood to imply the inclusion of stated elements but not the exclusion of any other elements. In addition, terms including "part", "module", and the like disclosed in the specification mean a unit that processes at least one function or operation and this may be implemented by hardware or software or a combination of hardware and software. Further, throughout the specification, when it is described that a certain part is "connected" with another part, it means that the certain part may be "directly connected" with another part and a third part may be interposed therebetween as well.

Hereinafter, the present invention will be described in detail with reference to the accompanying drawings.

FIG. 1 is a diagram schematically illustrating a configuration of a quasi-circulator using a 4-port symmetrical directional coupler 100 in the related art. Referring to FIG. 1, the 4-port symmetric directional coupler 100 in the related art as a passive reciprocal network including four ports (terminals) includes, for example, upper left, lower left, upper right, and lower right terminals.

For example, the upper left terminal represents a transmitter connection terminal 10 connected to a signal transmitter, an upper right terminal represents an antenna connection terminal 20 connected to an antenna, a lower left terminal represents a receiver connection terminal 30 connected with a signal receiver, and the lower right terminal represents a high-frequency resistor connection terminal 40. Here, the high-frequency resistor connection terminal 40 may be represented by a termination port as a terminal to which a termination resistor is connected.

That is, in an ideal 4-port symmetrical directional coupler 100, an RF signal inputted from the signal transmitter is transferred toward the antenna connection terminal 20 through the transmitter connection terminal 10, so that power corresponding to half of a total signal is transmitted to the antenna and half of power is transferred to the high-frequency resistor connection terminal 40, but almost most exhausted through a resistor terminal connected to reference impedance. Some very small signals are coupled toward the receiver connection terminal 30, which are a transmitting leakage signal.

Therefore, the signal corresponding to half of the signal input from a transmitter is transferred to an output terminal, and an abnormal signal loss of −3 dB internally occurs. A first transmission line 50 which becomes a main signal power path becomes a line in which the transmitter connection terminal 10 is formed at one end and the antenna connection terminal 20 is formed at the other end.

Further, the input signal from the transmitter has two signal paths passing through the first transmission line 50, a second coupling line 80, and a second transmission line 60 through a coupler structure with a first coupling line 70 directly connected up to a receiver. Since a length depending on a wavelength of each line becomes ¼, a signal passing through each line has a phase change of 90 degrees, and as a result, a phase difference due to two paths becomes 180 degrees. Therefore, the signal connected from the transmitter to the receiver is ideally offset.

Further, since a signal transferred to the high-frequency resistor connection terminal 40 of the input signal from the transmitter may be ideally completely absorbed and not reflected by a high-frequency resistor 90, a line formed from the direction of the antenna connection terminal 20 to the high-frequency resistor connection terminal 40 may be represented as the second coupling line 80.

In addition, referring to FIG. 1, the signal received through the antenna is transferred to the second coupling line 80 and the second transmission line 60 through the antenna connection terminal 20 and transferred to the receiver through the receiver connection terminal 30.

Here, in the 4-port symmetrical directional coupler 100 in the related art, impedance values of the first transmission line 50 and the second transmission line 60 are disposed to similarly have a Z1 value and impedance values of the first coupling line 70 and the second coupling line 80 are disposed to similarly have a Z2 value, and as a result, a structure of the directional coupler 100 is formed in a symmetric structure and is used as a circulator function by using the high-frequency resistor element 90 in a type using three ports. Further, in the 4-port symmetric directional coupler 100, each terminal is configured to have an impedance matching characteristic to match a 50-ohm reference impedance.

The 4-port symmetrical directional coupler 100 in the related art as a directional coupler having a symmetrical shape may be subjected to a matrix analysis classified into an even mode and an odd mode and expressed mathematically easily.

That is, since the 4-port symmetric directional coupler 100 in the related art has a problem that the isolation characteristic is deteriorated due to transmission line loss and inconsistency of a phase velocity between the even mode and the odd mode of the transmission line, the 4-port symmetric directional coupler 100 in the related art is difficult to realize as the circulator having the high transmitting/receiving signal isolation characteristic.

In the quasi-circulator using the asymmetric directional coupler 200, the existing mathematical analysis method applicable only to the symmetric structure may not be used due to the asymmetric characteristic, and therefore, there is a problem that it is difficult to express the circulator by a simple mathematical expression. That is, in order to express the quasi-circulator using the asymmetric directional coupler 200 in the even mode and the odd mode, it is necessary to divide the structure based on a symmetry plane, but the analysis is impossible due to a structural characteristic. An accurate expression is expressed in a repeated form of a matrix structure which may express characteristics including transmission and reflection of the signal depending on each component and represented by multiple transmission and reflection, and as a result, the accurate expression may be estimated by inferring a convergence result while increasing a degree of reflection of the signal.

Figure 2:
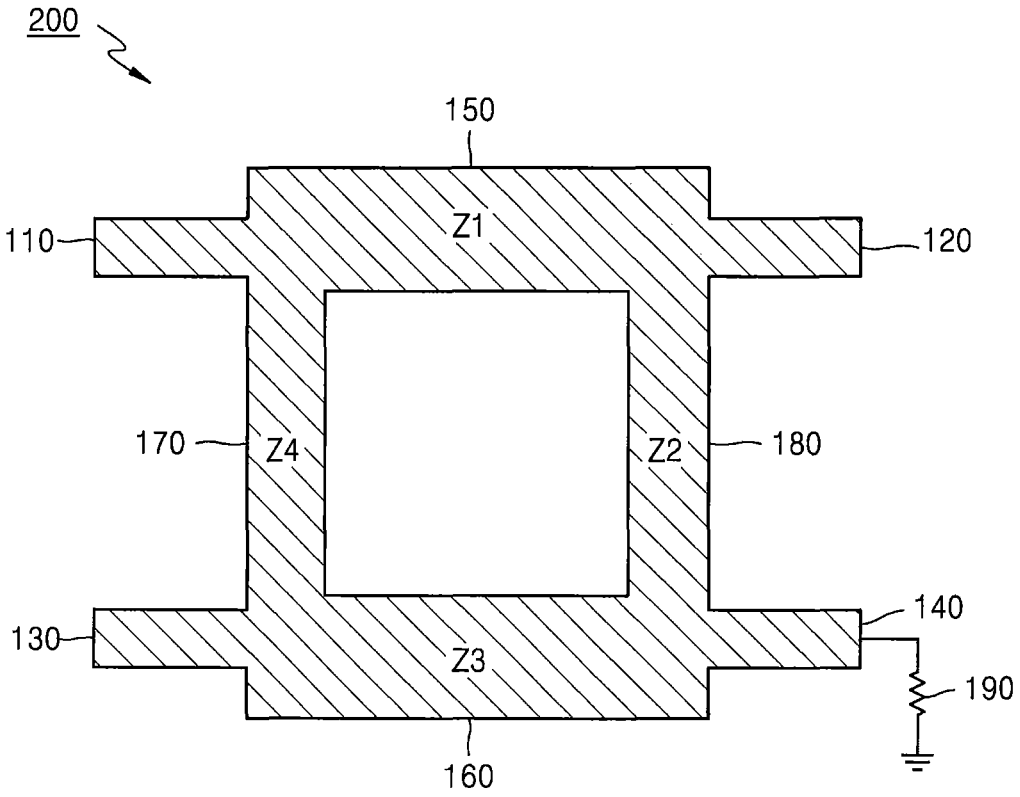
FIG. 2 is a diagram schematically illustrating a configuration of a quasi-circulator using an asymmetric directional coupler 200 according to an embodiment of the present invention.

FIG. 2 is a diagram schematically illustrating a configuration of a quasi-circulator using an asymmetric directional coupler 200 according to an embodiment of the present invention.

Referring to FIG. 2, as the structure using the asymmetric directional coupler 200, in the directional coupler 200, the upper left terminal represents a transmitter connection terminal 110 connected to a signal transmitter, an upper right terminal represents an antenna connection terminal 120 connected to an antenna, a lower left terminal represents a receiver connection terminal 130 connected with a signal receiver, and the lower right terminal represents a high-frequency resistor connection terminal 140. Here, the high-frequency resistor connection terminal 140 may be represented by a termination port as a terminal to which a termination resistor is connected.

Further, the circulator using the asymmetric directional coupler 200 according to an embodiment of the present invention includes a first transmission line 150 in which the transmitter connection terminal 110 is formed at one end and the antenna connection terminal 120 is formed at the other end and may include a second transmission line 160 disposed to be spaced apart from the first transmission line 150 by a predetermined interval, in which the receiver connection terminal 130 may be formed at one end and the high-frequency resistor connection terminal 140 may be formed at the other end.

In addition, the asymmetric directional coupler 200 may include a coupling line 170 vertically connected with the first transmission line 150 and the second transmission line 160, in which the transmitting signal from the transmitter connection terminal 110 is partially extracted and coupled to the receiver connection terminal 130 and may include an second coupling line 180 vertically connected with the first transmission line 150 and the second transmission line 160, from which the transmitting signal from the transmitter connection terminal 110 is electrically insulated.

Since the asymmetric directional coupler 200 according to an embodiment of the present invention has the asymmetric structure, the impedances of the first transmission line 150, the second transmission line 160, the first coupling line 170, and the second coupling line 180 may be arranged asymmetrically.

For example, referring to FIG. 2, the impedance value of the first transmission line 150 is disposed to have the Z1 value, the impedance value of the second transmission line 160 is disposed to have the Z3 value, the impedance value of the first coupling line 170 is disposed to have the Z4 value, and the impedance value of the second coupling line 180 is disposed to have the Z2 value, so that the impedance values of the respective lines may be disposed differently asymmetrically.

In addition, by setting line impedance of the high-frequency resistor connection terminal 140 and the high-frequency resistor connected thereto as arbitrary impedance other than the reference impedance, the signal is intentionally reflected on the corresponding terminal (port), and as a result, the reflection signal may be designed to offset the transmitting leakage signal. The high-frequency resistor 190 connected with the line impedance of the high-frequency resistor connection terminal 140 may be similarly configured.

Further, a length of each line of the asymmetric directional coupler 200 may be manufactured with 0.25λ similarly to the 4-port symmetric directional coupler 100 in the related art.

Figure 3:
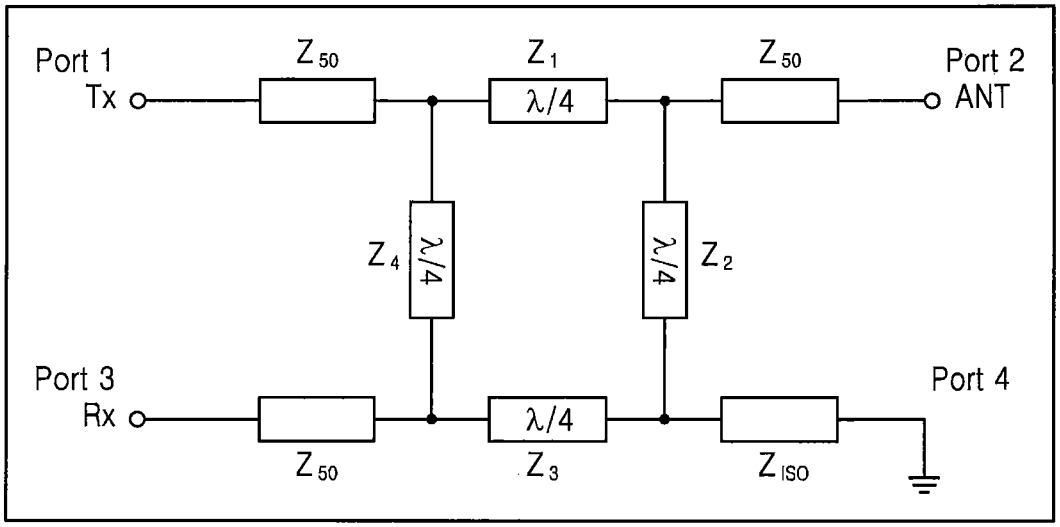
FIG. 3 is a diagram schematically a quasi-circulator using an asymmetric directional coupler 200 in order to construe the circulator by using S-parameters according to an embodiment of the present invention.

FIG. 3 is a diagram schematically illustrating a quasi-circulator using an asymmetric directional coupler 200 in order to construe the circulator by using S-parameters according to an embodiment of the present invention.

Referring to FIG. 3, the analysis using the S-parameters of the circulator using the asymmetric directional coupler 200 may be expressed by a combination of the impedance of each transmission line and the number of cases of signal lines transmitted from the input terminal to the output terminal.

Referring to FIGS. 2 and 3, Port 1 of FIG. 3 corresponds to the transmitter connection terminal 110 of FIG. 2, Port 2 of FIG. 3 corresponds to the antenna connection terminal 120 of FIG. 2, Port 3 of FIG. 3 corresponds to the receiver connection terminal 130 of FIG. 2, and Port 4 of FIG. 3 corresponds to the high-frequency resistor connection terminal 140 of FIG. 2.

When respective S-parameters from Port 1 to Port 3 are matched, the matched ports may be expressed as <Equation 1>. The S-parameters presented herein represent a power ratio between the input and output terminals of the asymmetric structure directional coupler 200.

Matched Ports from P1 to P3

$$S_{ii}=0(i=1,2,3) \qquad \text{[Equation 1]}$$

Further, referring to FIG. 3, since $Z_{50}$ connected to each terminal, which means that the impedance is 50 ohms, is equal to the reference impedance, that is, $Z_{50}=Z_{REF}$, $Z_{50}$ may be normalized, and as a result, m may be defined as in <Equation 2> below.

$$m = \frac{S_{44}}{S_{44}|_{matched}} \qquad \text{[Equation 2]}$$

Since the asymmetric directional coupler is constituted by a passive element, even though an input and an output are exchanged with each other, the input and the output exhibit the same characteristic. Therefore, the S parameter of each port may express by <Equation 3> below by using <Equation 1> in the following matrix form.

$$[S] = \begin{bmatrix} 0 & S_{21} & S_{31} & S_{41} \\ S_{12} & 0 & S_{32} & S_{42} \\ S_{13} & S_{23} & 0 & S_{43} \\ S_{14} & S_{24} & S_{34} & S_{44} \end{bmatrix} = \begin{bmatrix} 0 & S_{21} & S_{31} & S_{41} \\ S_{21} & 0 & S_{32} & S_{42} \\ S_{31} & S_{32} & 0 & S_{43} \\ S_{41} & S_{42} & S_{43} & S_{44} \end{bmatrix} \qquad \text{[Equation 3]}$$

Assuming that the circulator using the asymmetric directional coupler 200 has no loss due to signal transmission, the S-parameters of <Equation 3> may be expressed as <Equation 4> to <Equation 6> below.

Assumed that the device is Lossless, [Equation 4]

$$|S_{21}|^2 + |S_{31}|^2 + |S_{41}|^2 = 1$$

$$ⓓ\ |S_{21}|^2 + |S_{32}|^2 + |S_{42}|^2 = 1$$

$$ⓒ\ |S_{31}|^2 + |S_{32}|^2 + |S_{43}|^2 = 1$$

$$|S_{41}|^2 + |S_{42}|^2 + |S_{43}|^2 + |S_{44}|^2 = 1$$

$$ⓐ S_{31}S_{32}^* + S_{41}S_{42}^* = 0$$

$$ⓔ S_{21}S_{32}^* + S_{41}S_{43}^* = 0$$

$$S_{21}S_{42}^* + S_{31}S_{43}^* + S_{41}S_{44}^* = 0$$

$$S_{21}S_{31}^* + S_{42}S_{43}^* = 0$$

$$S_{21}S_{41}^* + S_{32}S_{43}^* + S_{42}S_{44}^* = 0$$

$$ⓑ S_{31}S_{41}^* + S_{32}S_{42}^* + S_{43}S_{44}^* = 0$$

[Equation 5]

$$ⓐ S_{31}S_{32}^* + S_{41}S_{42}^* = 0 \rightarrow S_{31}^*S_{32} + S_{41}^*S_{42} = 0 \rightarrow S_{31}^*S_{32}S_{42}^* + S_{41}^*|S_{42}|^2 = 0$$

$$ⓑ S_{31}S_{41}^* + S_{32}S_{42}^* + S_{43}S_{44}^* = 0 \rightarrow |S_{31}|^2 S_{41}^* + S_{32}S_{42}^*S_{31}^* + S_{43}S_{44}^*S_{31}^* = 0$$

$$\Rightarrow S_{41}^*(|S_{31}|^2 - |S_{42}|^2) + S_{43}S_{44}^*S_{31}^* = 0$$

[Equation 6]

$$\left.\begin{array}{l} ⓒ\ |S_{31}|^2 + |S_{32}|^2 + |S_{43}|^2 = 1 \\ ⓓ\ |S_{21}|^2 + |S_{32}|^2 + |S_{42}|^2 = 1 \end{array}\right\}$$

$$|S_{31}|^2 - |S_{42}|^2 = |S_{21}|^2 - |S_{43}|^2$$

When the result of <Equation 6> is substituted into <Equation 5>, <Equation 7> below may be obtained.

$$S^*_{41}(|S_{21}|^2-|S_{43}|^2+S_{43}S^*_{44}S^*_{31}=0 \quad \text{[Equation 7]}$$

In <Equation 7>, when $S_{21}$ is defined as α, $S_{21}$ and $S_{43}$ may be defined as in <Equation 8> below and may be expressed by real numbers.

$$S_{21}\equiv\alpha, S_{43}\equiv\beta=\alpha\cdot k\cdot m \quad \text{[Equation 8]}$$

k: Transmittance ratio from the impedance difference between $Z_1$ and $Z_3$

When a defined value (α) of $S_{21}$ and a defined value (α·k·m) of $S_{43}$ are substituted into <Equation 7> by using <Equation 8>, <Equation 9> may be obtained.

$$S^*_{41}(\alpha^2-\alpha^2k^2m^2)+\alpha km\cdot m^*S^*_{31}=0$$

$$S^*_{41}(\alpha^2-\alpha^2k^2m^2)+\alpha km^2S^*_{31}=0 \quad \text{[Equation 9]}$$

When a complex conjugate is calculated by using Equation ⓔ in <Equation 4> and thereafter, a complex conjugate value (α*) of $S_{21}$ and the defined value (α·k·m) of $S_{43}$ are substituted, $S^*_{41}$ may be expressed as in <Equation 10> below.

$$S_{21}S^*_{32}+S_{41}S^*_{43}=0\rightarrow S^*_{21}S_{32}+S^*_{41}S_{43}= \quad \text{[Equation 10]}$$

$$0\rightarrow S^*_{41}=-\frac{S^*_{21}S_{32}}{S_{43}}=-\frac{\alpha^*}{\alpha km}S_{32}=-\frac{S_{32}}{km}$$

When <Equation 9> and <Equation 10> are used, $S^*_{31}$ may be expressed as in <Equation 11> below.

$$S^*_{31}=\frac{S^*_{41}(\alpha k^2m^2-\alpha)}{km^2}=\frac{(\alpha-\alpha k^2m^2)}{k^2m^3}S_{32}=\frac{\alpha(1-k^2m^2)}{k^2m^3}S_{32} \quad \text{[Equation 11]}$$

That is, by <Equation 11>, a design parameter may be decided as in <Equation 12> below.

$$S^*_{31}=\frac{\alpha(1-k^2m^2)}{k^2m^3}S_{32}\Rightarrow \text{Design Parameter: } |k\cdot m|=1 \quad \text{[Equation 12]}$$

That is, the impedance value of each line and/or the impedance value of the high frequency resistor may be estimated and designed to satisfy |k·m|=1 which is the design parameter in order to make a value of $|S_{31}|$ to 0 so that the transmitting and receiving terminals of the circulator using the asymmetric directional coupler 200 are perfectly isolated. That is, by adjusting an impedance ratio and an element value connected to an impedance setting port, it is possible to implement a circulator with improved transmitting/receiving isolation signal characteristics.

Assuming perfect signal isolation from Port 1 to Port 3 of the circulator using the asymmetric directional coupler 200, since $S_{31}=0$ is satisfied as in <Equation 12>, the S-parameters may be expressed as in <Equation 13> below.

Perfect Isolation from $P1$ to $P3$: $S_{31}=0$ [Equation 13]

$$\boxed{\begin{aligned}&|S_{21}|^2+|S_{41}|^2=1\\&|S_{21}|^2+|S_{32}|^2+|S_{42}|^2=1\\&|S_{32}|^2+|S_{43}|^2=1\\&|S_{41}|^2+|S_{42}|^2+|S_{43}|^2+|S_{44}|^2=1\end{aligned}}$$

$$[S]=\begin{bmatrix}0 & S_{21} & 0 & S_{41}\\ S_{21} & 0 & S_{32} & S_{42}\\ 0 & S_{32} & 0 & S_{43}\\ S_{41} & S_{42} & S_{43} & S_{44}\end{bmatrix}$$

Respective equations of <Equation 13> are added and summarized to be expressed as in <Equation 14> and <Equation 15>.

$$\begin{aligned}|S_{21}|^2+|S_{41}|^2+|S_{21}|^2+|S_{32}|^2+|S_{42}|^2+|S_{32}|^2+|S_{43}|^2&=2|S_{21}|^2+2|S_{32}|^2+|S_{41}|^2+|S_{42}|^2+|S_{43}|^2=3\\&=2|S_{21}|^2+2|S_{32}|^2+1-|S_{44}|^2\end{aligned} \quad \text{[Equation 14]}$$

$$(|S_{21}|^2+|S_{32}|^2)-0.5|S_{44}|^2=1 \quad \text{[Equation 15]}$$

In other words, by using <Equation 15>, the circulator using the asymmetric directional coupler 200 is designed to increase $|S_{21}|$ and $|S_{32}|$, so that the circulator may maintain the high transmitting/receiving isolation signal characteristic while being designed in such a manner to transmit more outputs upon transmitting and minimize loss occurring upon receiving, and as a result, the circulator may be designed with a characteristic suitable for the operation of the circulator.

It can be confirmed that the circulator using the 4-port symmetrical directional coupler 100 in the related art has a lower transmitting/receiving isolation signal characteristic than the circulator using the asymmetric directional coupler 200 and has only approximately $|S_{21}|=|S_{32}|=1/\sqrt{2}$.

That is, in the quasi-circulator using the asymmetric directional coupler 200 according to an embodiment of the present invention, the impedances of the first transmission line 150, the second transmission line 160, the first coupling line 170, and the second coupling line 180 may be arranged asymmetrically to maintain the high transmitting/receiving isolation signal characteristic. Here, each of the impedance values for arranging the impedance of each line asymmetrically may be estimated by adjusting the ratio of the impedance of each line and the element value connected to the impedance setting port. Here, as the impedance setting port includes all four connection terminals 110, 120, 130, and 140 of the asymmetric directional coupler 200 and in the asymmetric directional coupler 200, the reflection signal is generated by setting only the high-frequency resistor connection terminal 140 (termination port) as a predetermined impedance value, and as a result, the reflection signal may be designed to offset the transmission leakage signal.

That is, in the asymmetric directional coupler 200, all of the transmitter, the receiver, and the termination port connected to the antenna need to be designed in consideration of impedance matching with the reference impedance, and therefore, the impedance setting is configured based on 50 ohms. Therefore, the line of the transmitter connection terminal 110, the line of the antenna connection terminal 120, and the line of the receiver connection terminal 130 may be all configured to have a characteristic impedance of 50 ohms. Since the high-frequency resistor connection terminal 140 (termination port) is configured to have a predetermined reflection characteristic, the connection line of the high-frequency resistor connection terminal 140 is designed to have the same impedance value as the high-frequency resistor 190. Therefore, the connection line of the high-frequency resistor connection terminal 140 and the high-frequency resistor 190 may be represented as impedance setting ports for optimally designing the asymmetric directional coupler 200 as the circulator.

For example, the line of the transmitter connection terminal 110, the line of the antenna connection terminal 120, and the line of the receiver connection terminal 130 may be all configured to have a characteristic impedance of 50 ohms and the high-frequency resistor connection terminal 140 may be configured to have an impedance value to generate the reflection signal for offsetting the transmission leakage signal.

That is, the connection lines of the high-frequency resistor 190 connected to the high-frequency resistor connection terminal 140 and the high-frequency resistor connection terminal 140 are configured to have a different value from the reference impedance value (50 ohms), whereby the asymmetric directional coupler 200 may be designed as the optimal circulator.

That is, the quasi-circulator using the asymmetric directional coupler 200 according to an embodiment of the present invention may be designed by estimating the impedance value of each line so as to satisfy $|k \cdot m|=1$ which is the design parameter.

Figure 4A:
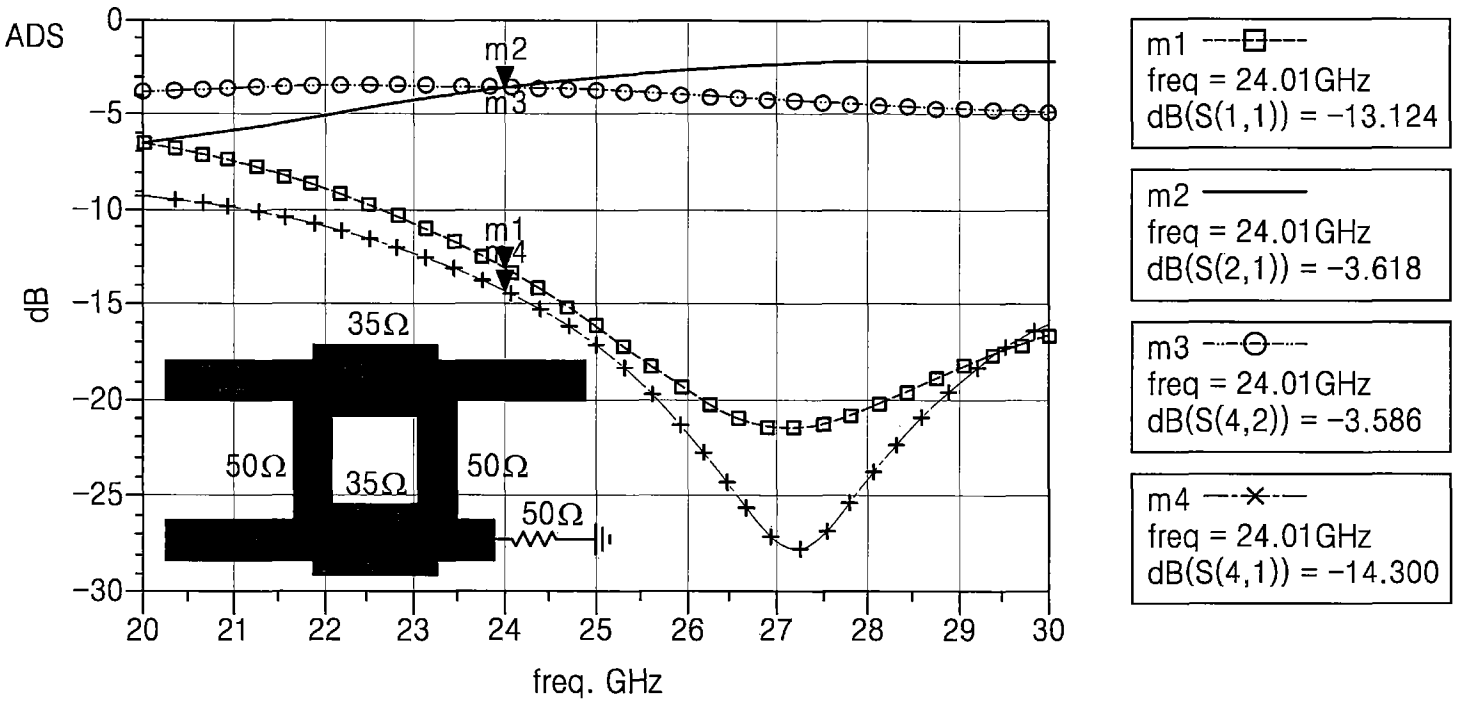
FIG. 4A is a diagram illustrating a simulation result of S-parameters of the circulator using the symmetric directional coupler 100 in the related art and FIG. 4B is a diagram illustrating a simulation result of S-parameters of the circulator using the asymmetric directional coupler 200 according to an embodiment of the present invention.
Figure 4B:
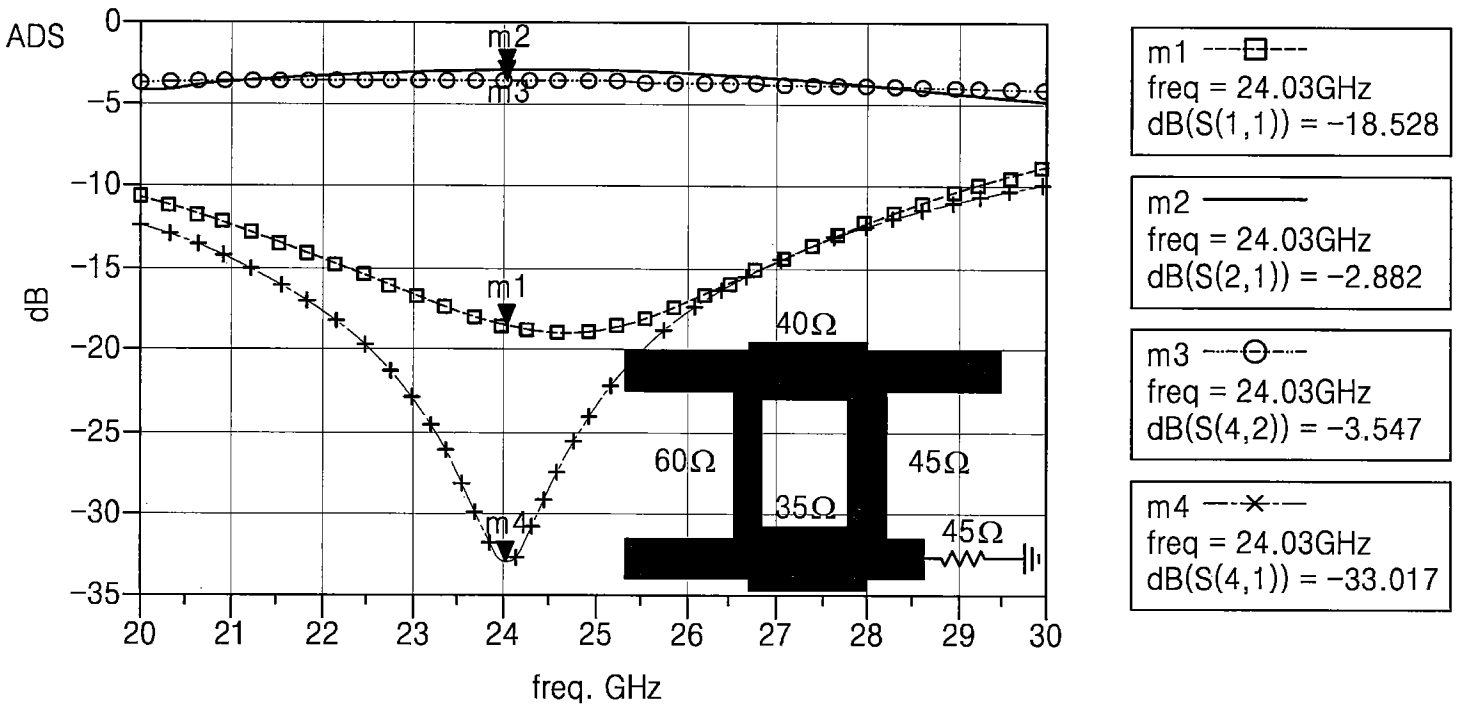

FIG. 4A is a diagram illustrating a simulation result of S-parameters of the quasi-circulator using the symmetric directional coupler 100 in the related art and FIG. 4B is a diagram illustrating a simulation result of S-parameters of the circulator using the asymmetric directional coupler 200 according to an embodiment of the present invention.

Here, S-parameter simulation results are based on electromagnetic wave simulation by designing a 24-GHz directional coupler with a circulator function implemented on Rogers's RO3003 substrate, which has excellent characteristics in a high frequency over 20 GHz. That is, FIG. 4A illustrates a diagram illustrating a result of performing a simulation by designing a 24-GHz directional coupler with a circulator function by using the symmetric directional coupler 100 in the related art and FIG. 4B is a diagram illustrating a result of performing a simulation by a 24-GHz directional coupler with a circulator function by using the asymmetric directional coupler 200 according to an embodiment of the present invention.

Referring to FIG. 4A, as the structure of the symmetric directional coupler 100 in the related art, it can be seen that the simulation result is obtained by deciding the impedance values of the first transmission line 50 and the second transmission line 60 as 35 ohms, the impedance values of the first coupling line 70 and the second coupling line 80 as 50 ohms, and the impedance connected to the high-frequency resistor connection terminal 40 as 50 ohms.

That is, referring to FIG. 4A, it can be seen that signal loss of −3.5 dB occurs in each of a transmission $S_{21}$ parameter and a reception $S_{42}$ parameter in a 24-GHz band. Further, it can be seen that a transmitting/receiving leakage signal may be −14.3 dB.

Referring to FIG. 4B, as the structure of the quasi-circulator using the asymmetric directional coupler 200 according to an embodiment of the present invention, it can be seen that the simulation result is obtained by deciding the impedance value of the first transmission line 150 as 40 ohms, the impedance value of the second transmission line 160 as 35 ohms, the impedance value of the first coupling line 170 as 60 ohms, the impedance value of the second coupling line 180 as 45 ohms, and the impedance connected to the high-frequency resistor connection terminal 140 as 45 ohms so that the impedance of each line of the directional coupler has the asymmetric structure.

Here, the impedance value of each line of the asymmetric directional coupler 200 is an estimated value that the transmitting leakage signal is minimized by adjusting the transmission line impedance, thereby forming the asymmetric structure directional coupler 200. For example, the impedance value of each line in FIG. 4B corresponds to an example in which a frequency band in which the transmitting/receiving isolation characteristic is minimized and a frequency band in which signal attenuation from the transmitter to the antenna and signal attenuation from the antenna to receiver are minimized match each other to estimate the impedance value of each line.

Further, in the quasi-circulator using the asymmetric directional coupler 200 according to an embodiment of the present invention, 50 ohms which is the reference impedance may be connected to other connection terminals. That is, since the reference impedance of the circulator using the asymmetric directional coupler 200 is the same as that of other conventional element, it is possible to directly replace the circulator using the symmetrical directional coupler 100 in the related art and it is not necessary to use an additional element for frequency matching.

That is, referring to FIG. 4B, since the signal loss occurring in the transmission $S_{21}$ parameter and the reception $S_{42}$ parameter is almost the same as the signal loss occurring in the structure of the symmetric directional coupler 100 in the related art, it can be confirmed that the structure has almost the same characteristic as the structure of the symmetrical directional coupler 100.

Further, referring to FIG. 4B, it can be seen that in the quasi-circulator using the asymmetric directional coupler 200, transmitting/receiving isolation characteristics of the leakage signal between transmitting and receiving paths are significantly enhanced as −33 dB. In addition, it can be seen that the frequency band indicated by the leakage signal is shown widely as compared with the directional coupler in the related art, a broadband characteristic is excellent. As shown in the asymmetric directional coupler analysis, by an asymmetric directional coupler operation of which characteristic is decided by multiple transmissions and reflections, an influence on a wavelength is insensitive as compared with the structure in the related art, and as a result, the structure may have an excellent characteristic in operating as the circulator in a wider area.

That is, the quasi-circulator using the asymmetric directional coupler 200 according to an embodiment of the present invention may cause the isolation between the transmitting and receiving signals by arranging impedance of each line asymmetrically.

For example, in respect to the impedance value of each line of the directional coupler 200, each impedance value and/or the high-frequency resistor impedance value may be estimated by adjusting a ratio of the impedance of each line and an element value connected to the impedance setting port so as to enhance the characteristic of separating the transmitting and receiving signals.

That is, like contents of <Equation 12> described above, the impedance value of each line and/or the impedance value of the high-frequency resistor may be estimated and designed to satisfy $|S_{31}|$ which is the design parameter in order to make a value of $|k \cdot m|=1$ to 0 so that the transmitter and the receiver of the circulator using the asymmetric directional coupler 12 are perfectly isolated.

Further, by using <Equation 15> described above, the quasi-circulator using the asymmetric directional coupler 200 is designed to increase $|S_{21}|$ and $|S_{32}|$, so that the impedance value and/or a high-frequency resistor impedance value of each line may be estimated to transmit more outputs upon transmitting and minimize loss occurring upon receiving.

In addition, in the quasi-circulator using the asymmetric directional coupler 200 according to an embodiment of the present invention, by setting the high-frequency resistor connected to the high-frequency resistor connection terminal 140 as arbitrary impedance other than the reference impedance, the signal is intentionally reflected, and as a result, the reflection signal may be designed to offset the transmitting leakage signal.

For example, the high-frequency resistor connection terminal 140 of the asymmetric directional coupler 200 may include an element having an impedance value to generate a signal which has the same magnitude as and an opposite phase to a signal which leaks from the transmitter connection terminal 100 of the first transmission line 150 to the receiver connection terminal 130 of the second transmission line 160 to intentionally reflect the signal on the high-frequency resistor connection terminal 140, and as a result, the reflection signal may be designed to offset the transmission leakage signal.

That is, since the circulator using the asymmetric directional coupler 200 has the same transmission signal loss as the transmission loss of the symmetric directional coupler 100 in the related art, the circulator may transmit the signal without additional loss. Further, since the circulator using the asymmetric directional coupler 200 according to an embodiment of the present invention has a wide frequency bandwidth due to an asymmetric structure and has low frequency dependency, the circulator is less influenced by the error in fabrication and may be used for broadband applications.

The aforementioned description of the present invention is used for exemplification, and it can be understood by those skilled in the art that the present invention can be easily modified in other detailed forms without changing the technical spirit or requisite features of the present invention. Therefore, it should be appreciated that the aforementioned embodiments are illustrative in all aspects and are not restricted. For example, respective constituent elements described as single types can be distributed and implemented, and similarly, constituent elements described to be distributed can also be implemented in a coupled form.

The scope of the present invention is represented by claims to be described below rather than the detailed description, and it is to be interpreted that the meaning and scope of the claims and all the changes or modified forms derived from the equivalents thereof come within the scope of the present invention.

What is claimed is:

1. A quasi-circulator using an asymmetric directional coupler, wherein the asymmetric directional coupler comprises:

a first transmission line in which a transmitter connection terminal is formed at one end and an antenna connection terminal is formed at another end;

a second transmission line disposed to be spaced apart from the first transmission line by a predetermined interval, in which a receiver connection terminal is formed at one end and a high-frequency resistor connection terminal is formed at the other end;

a first coupling line vertically connected with the first transmission line, in which the second transmission line and a transmitting signal from the transmitter connection terminal is partially extracted and coupled to the receiver connection terminal; and a second coupling line vertically connected with the first transmission line and the second transmission line, from which the transmitting signal from the transmitter connection terminal is configured to be electrically isolated, and wherein the first transmission line, the second transmission line, the first coupling line, and the second coupling line are arranged in a square to implement a circulator function of isolating the transmitting signal from a receiving signal, and wherein respective impedances of the first transmission line, the second transmission line, the first coupling line, and the second coupling line that comprise respective branches of the square are asymmetrical to one another.

2. The quasi-circulator using the asymmetric directional coupler of claim 1, wherein in estimation of each impedance value which causes the impedances of the first transmission line, the second transmission line, the first coupling line, and the second coupling line to be arranged asymmetrically, each impedance value is estimated by adjusting a ratio of the impedances of the respective lines and an element value connected to a termination port.

3. The quasi-circulator using the asymmetric directional coupler of claim 1, wherein in estimation of each impedance value which causes the impedances of the first transmission line, the second transmission line, the first coupling line, and the second coupling line to be arranged asymmetrically, each impedance value is estimated by using a design parameter equation.

4. The quasi-circulator using the asymmetric directional coupler of claim 1, wherein the high-frequency resistor connection terminal includes a high-frequency resistor element having an impedance value to generate a signal having a same magnitude as and an opposite phase to a signal which leaks from the transmitter connection terminal of the first transmission line to the receiver connection terminal of the second transmission line.

5. The quasi-circulator using the asymmetric directional coupler of claim 1, wherein the impedance of the first transmission line is disposed as 40 ohms, the impedance of the second transmission line is disposed as 35 ohms, the impedance of the first coupling line is disposed as 60 ohms, and the impedance of the second coupling line is disposed as 45 ohms, and the impedance connected to the high-frequency resistor connection terminal is disposed as 45 ohms and respective line impedances of the asymmetric directional coupler are disposed asymmetrically.

6. The quasi-circulator using the asymmetric directional coupler of claim 3, wherein the design parameter equation is $|k \cdot m|=1$.

7. The quasi-circulator using the asymmetric directional coupler of claim 1, wherein the line of the transmitter connection terminal, the line of the antenna connection terminal, and the line of the receiver connection terminal are all configured to have a characteristic impedance of 50 ohms, and the high-frequency resistor connection terminal is configured to have an impedance value to generate a reflection signal for offsetting a transmitting leakage signal.

8. The quasi-circulator using the asymmetric directional coupler of claim 7, wherein a high-frequency resistor connected to the high-frequency resistor connection terminal is configured to have a different value from a reference impedance value (50 ohms).

9. The quasi-circulator using the asymmetric directional coupler of claim 7, wherein a connection line of the high-frequency resistor connection terminal is configured to have a different value from a reference impedance value (50 ohms).

* * * * *